US011898228B2

(12) United States Patent
Hardy et al.

(10) Patent No.: US 11,898,228 B2
(45) Date of Patent: Feb. 13, 2024

(54) ALLOY

(71) Applicant: ROLLS-ROYCE plc, London (GB)

(72) Inventors: Mark C Hardy, Derby (GB); David Dye, London (GB); Lucy Reynolds, London (GB); Thomas McAuliffe, London (GB); Ioannis Bantounas, London (GB)

(73) Assignee: ROLLS-ROYCE PLC, London (GB)

( * ) Notice: Subject to any disclaimer, the term of this patent is extended or adjusted under 35 U.S.C. 154(b) by 63 days.

(21) Appl. No.: 17/402,699

(22) Filed: Aug. 16, 2021

(65) Prior Publication Data

US 2023/0131449 A1 Apr. 27, 2023

(30) Foreign Application Priority Data

Aug. 20, 2020 (GR) ..... 20200100502

(51) Int. Cl.
*C22C 30/00* (2006.01)
*C22C 19/05* (2006.01)

(52) U.S. Cl.
CPC ..... *C22C 30/00* (2013.01); *C22C 19/056* (2013.01); *C22C 19/057* (2013.01)

(58) Field of Classification Search
CPC ..... C22F 1/10; C22C 19/056; C22C 19/057; C22C 30/00
See application file for complete search history.

(56) References Cited

U.S. PATENT DOCUMENTS

| | | | |
|---|---|---|---|
| 2011/0203707 | A1 | 8/2011 | Mourer et al. |
| 2013/0167687 | A1 | 7/2013 | Gu et al. |
| 2013/0209265 | A1 | 8/2013 | Reynolds et al. |
| 2014/0205449 | A1 | 7/2014 | Mourer et al. |
| 2015/0012428 | A1 | 1/2015 | Gray et al. |
| 2018/0305792 | A1 | 10/2018 | Forsik et al. |
| 2019/0360077 | A1 | 11/2019 | Hardy et al. |

FOREIGN PATENT DOCUMENTS

| | | | | |
|---|---|---|---|---|
| EP | 1201777 | A1 | 5/2002 | |
| EP | 2628811 | A1 | 8/2013 | |
| EP | 3572541 | A1 * | 11/2019 | ..... C22C 1/0433 |
| GB | 2554898 | A | 4/2018 | |
| GB | 2573572 | A | 11/2019 | |
| WO | 2012/047352 | A2 | 4/2012 | |

OTHER PUBLICATIONS

Jan. 6, 2021 Search Report issued in British Patent Application No. 2015106.4.
Dec. 21, 2021 Extended European Search Report issued in Patent Application No. 21190470.1.

* cited by examiner

*Primary Examiner* — Jessee R Roe
(74) *Attorney, Agent, or Firm* — Oliff PLC

(57) ABSTRACT

A nickel-cobalt based superalloy composition consisting of by weight (wt.): 33.5 to 54 percent Ni; 19.5 to 36 percent Co; 9 to 12 percent Cr; 3.9 to 5.5 percent Al; 4.5 to 9.5 percent W; up to 5.5 percent Fe; 2 to 3.5 percent Mo; 0.6 to 5 percent Ta; 0.15 to 2.2 percent Ti; up to 1.75 percent Nb; up to 0.1 percent Hf; 0.005 to 0.03 percent C; 0.001 to 0.02 percent B; 0.005 to 0.06 percent Zr; up to 0.3 percent Si; up to 0.6 percent Mn; and the balance being impurities.

21 Claims, 2 Drawing Sheets

ALLOY

TECHNICAL FIELD

The invention relates to alloys suitable for high temperature applications and particularly nickel-cobalt based alloys that may be used to manufacture components in a gas turbine engine.

BACKGROUND

Many components in the hot section of gas turbine engines are expected to operate for extended periods of time at temperatures above 800° C. Components that operate in these conditions can be subject to significant stresses caused by rotational, pressure or other forces and thermal gradients. There are other, static components and structures that experience much lower stresses, and as such can tolerate higher temperatures, up to 950° C.

There is a requirement to provide improved alloys that extend temperature capability, reduce weight or cost, or increase the number of operating cycles and operation time for components within difficult conditions in order to provide an affordable service life.

It is an object of the present invention to seek to provide an improved nickel-cobalt based alloy.

Current nickel-cobalt based alloys, which are precipitation strengthened by ordered $L1_2$ gamma prime (γ') precipitates, show one or many of the following disadvantages:

Relatively low yield stress levels compared to precipitation strengthened nickel-based alloys. It is understood that low yield stress is due to low Anti Phase Boundary (APB) energy. This is the energy that is produced from pairwise penetration and cutting of dislocations through γ' precipitates. Such precipitation hardening is the main contributor to strength in nickel-based alloys.

The current alloy compositions can show unwanted secondary phases such as NiAl, CoAl (B2 phase), $Co_3Al$ ($D0_{19}$ χ phase), $Co_7M_6$ ($D8_5$ μ phase), borides ($M_2B$), carbides ($M_6C$).

The current alloy compositions can have high density levels at 20° C.>8.5 g.cm$^{-3}$.

The current alloy compositions can show poor oxidation resistance at temperatures over 800° C., if sufficient levels of chromium and aluminium are not added. Whilst there is the potential for good Type I hot corrosion resistance, given the high Co content, the Type II hot corrosion resistance is likely to be worse than existing nickel-based alloys.

Un-optimised solid solution strengthening in the gamma (γ) phase as large fraction (circa 0.4) of added tungsten partitions to γ' precipitates.

Un-optimised grain boundary strengthening from carbides, borides and sulphur scavengers such as zirconium.

Expensive raw material costs due to price of cobalt.

BRIEF SUMMARY

According to the invention there is provided a nickel-cobalt alloy composition comprising by weight (wt.): 33.5 to 54 percent Ni; 19.5 to 36 percent Co; 9.0 to 12.0 percent Cr; 3.9 to 5.5 percent Al; 4.5 to 9.5 percent W; up to 5.5 percent Fe; 2 to 3.5 percent Mo; 0.6 to 5 percent Ta; 0.15 to 2.2 percent Ti; up to 1.75 percent Nb; up to 0.1 percent Hf ; 0.005 to 0.03 percent C; 0.001 to 0.02 percent B; 0.005 to 0.06 percent Zr; up to 0.3 percent Si; up to 0.6 percent Mn; and the balance being impurities.

Preferably, Ni and Co are present in the Ni:Co ratio between 1:1 and about 2.6:1 in atomic percent.

The alloy may comprise by atomic percentage: 9-11.5 percent Al; 1.5 to 3 percent W; 0.25-1.6 percent Ta; 0.3-2.5 percent Ti; and up to 1 percent Nb; wherein a combined atomic percentage of Al, Ta, Ti, Nb and 0.62 of W in the nickel-cobalt based superalloy is between 12.5 and 16.25 percent to provide substantially 50 to 65 percent by volume gamma prime precipitates.

The alloy may comprise by atomic percentage: 1.5-3 percent W; 1.3-2 percent Mo; wherein a combined atomic percentage of Mo+0.38 of W in the nickel-cobalt based superalloy is at least 2.44 percent.

The alloy density at ambient temperature is less than 8.7 grams per cubic centimetre. Preferably, alloy density is less than 8.5 grams per cubic centimetre, which requires a combined atomic percentage of Mo+0.38 of W to be no greater than 2.5 percent and a combined atomic percentage of W+Ta+Nb to be no greater than 3.8 percent.

The gamma prime solvus temperature ($T_{solvus}$) of the alloy is between 1020 and 1125° C. This is the temperature at which all γ' precipitates dissolve, with constituent elements returning to the γ phase.

An optimised oxidation resistance in the proposed alloy is achieved with high values of Cr and Al to maximise the Cr:Ti and Al:Cr ratios in atomic percent. The aim is to promote the formation of a continuous alumina layer, rather than alumina intrusions, below the chromia scale.

The alloy can be readily hot formed above $T_{solvus}$, despite having a large volume fraction (up to 65%) of γ' precipitates. The hot working range of the alloy is much larger than that for nickel-based alloys with similar fractions of γ' precipitates due to lower values of $T_{solvus}$.

BRIEF DESCRIPTION OF THE DRAWINGS

Embodiments will now be described by way of example only, with reference to the Figures, in which:

FIG. 2(*a*) shows dark B2 (NiAl) phase in an alloy with 12 at. % Al (>5.5 wt. %). FIG. 2(*b*) shows that the dark B2 phase is not formed in an alloy with 10 at. % Al. The light phase is $M_6C$ at grain boundaries and intragranular MC carbide for an alloy with 0.3 at. % C (0.06 wt. %) and 0.11 at. % B (0.02 wt. %);

DETAILED DESCRIPTION

Figure 1:
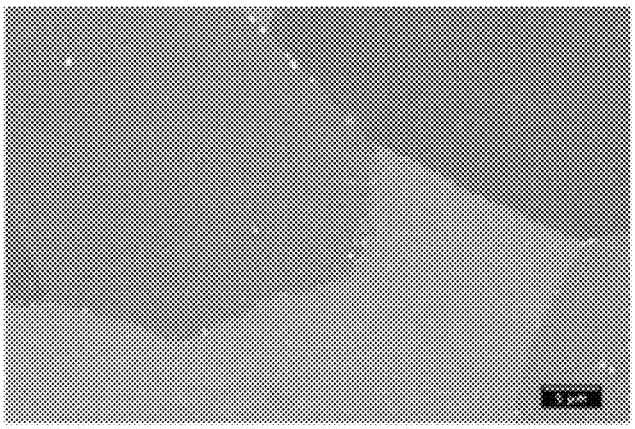
FIG. 1 illustrates a backscatter electron image of an example alloy showing minimal grain boundary decoration of carbides and boride particles. The alloy contains 0.1 at. % C (0.02 wt. %) and 0.042 at. % B (0.007 wt. %)

Subjecting some Ni containing alloys to specific heat treatments or other processing steps permits precipitation strengthening by the formation of ordered $L1_2$ gamma prime (γ') precipitates. Gamma prime is described by $Ni_3X$ where X is predominantly Al with progressively smaller proportions of Ti, Ta and Nb. Nickel-cobalt-based alloys containing Al and W can be precipitation strengthened by the ordered $L1_2$ $Co_3(Al, W)$ γ′ precipitates as well as the $Ni_3X\gamma'$ precipitates that are found in conventional Ni base superalloys.

The ordered $L1_2\gamma'$ phase of Co is denser than a disordered Co matrix such that the precipitation of the γ′ phase increases the density of the alloy whilst the high temperature strength and temperature capability is improved. The density of the alloy has a component weight penalty that offsets the improved temperature capability of the alloy.

By contrast the ordered $L1_2\gamma'$ phase of nickel is less dense than the matrix Ni, such that an increase in γ′ content results in a reduction in alloy density whilst simultaneously increasing the temperature and capability and strength of the alloy.

Anti-phase boundary (APB) energy is produced from pairwise penetration and cutting of dislocations through γ′ precipitates. Such precipitation hardening is the main contributor to strength in Ni-based alloys. Pairs of dislocations cut γ′ precipitates to produce stacking faults. The magnitude of the APB energy associated with these stacking faults is dependent on the composition of the γ′ precipitates. In Ni-base superalloys, replacing Al in γ′ by Ti, Ta and Nb increases APB energy. In Co-base alloys containing Al and W, it is understood that W in $Co_3(Al, W)$ γ′ can be replaced by Nb, which can reduce alloy density if W levels are reduced or increases the partitioning of W to the gamma (γ) matrix phase. The γ′ phase is meta-stable in the Co—Al—W ternary phase diagram. The phase is stabilised by the addition of Ni. Increasing amounts of Ni also increase the proportion of $Ni_3X\gamma'$ precipitates, which produce higher APB energy when cut by pairs of dislocations compared to $Co_3(Al, W)$ γ′ precipitates. To achieve this, the Ni:Co ratio (in atomic percent) in the proposed alloys is varied from 1:1 to about 2.6:1. Where Ni and Co are present in these ratios, a density increase from the formation of the $L1_2\gamma'$ phase of Co is offset by a density reduction of the ordered $L1_2\gamma'$ phase of Ni particularly where γ′ has a continuous phase field between $Ni_3AI,X$ (where X=Ti, Ta, Nb) and $Co_3Al,Z$ (where Z=W, Ta, Nb).

Atom probe tomography (APT) has shown that W partitions to both γ and γ′ (M. Knop et al., 2014, *JOM*, 66 (12), p. 2495). The partitioning of W between these phases depends on the Ni content in the alloy. For an alloy with a Ni:Co ratio of about 1:1, the W content in γ can be 0.62 and 0.38 in γ.

To produce the required levels of strength, alloys have been designed that precipitate between 50 and 65% of the γ′ phase. To achieve this, Al+Ti+Ta+Nb+0.62W>12.5 at. % but no greater than 16.25 at. % (Table 3). However, there are limits for each of these elements, i.e. Al from 9-11.5 at. %, Ti from 0.3-2.5 at. %, Ta from 0.25-1.6 at. %, Nb from 0 to 1 at. %, and W from 1.5-3 at. % to ensure the desired balance of material properties and resistance to environmental damage.

The aim is to produce nickel-cobalt superalloys with density values at ambient temperature of less than 8.5 $g.cm^{-3}$, which requires that W+Ta+Nb 3.8 at. % and Mo+0.38W 2.5 at. %.

Yield strength is also determined by the size, as well as the composition of γ′ precipitates. Slow diffusion of Nb, Ta and W in Ni and Co minimises coarsening of γ′ precipitates after nucleation at temperatures below $T_{solvus}$. The size of the γ′ precipitates is also determined by $T_{solvus}$, such that smaller precipitates are produced in alloys with lower $T_{solvus}$ values as the rate of coarsening is reduced at lower temperatures. Increased levels of Co and Cr reduce $T_{solvus}$ whilst increasing amounts of Ni, Al, Ti and Ta increase $T_{solvus}$. In the proposed alloys, a 1 at. % reduction in Cr increases $T_{solvus}$ by 20° C.

For Ni-based superalloys, there are 2 precipitation strengthening mechanisms (weak and strong pair coupling), which depend on the size of γ′ precipitates. Weak pair coupling for yield strength and optimised resistance to creep deformation requires γ′ precipitates<about 35 nm. These are typically tertiary γ′ precipitates that are formed during ageing heat treatment and during cooling from solution heat treatment at temperatures below 800° C. Strong pair coupling for optimising yield strength requires γ′ precipitates>about 50 nm. These are secondary γ′ precipitates that are formed during cooling from solution heat treatment, which for the proposed alloys is conducted at temperatures above $T_{solvus}$ for a time period of about 1 to 2 hours. It is proposed that optimised yield strength, creep resistance and ductility can be achieved by producing a bimodal size distribution of γ′ precipitates in the proposed nickel-cobalt alloys, i.e. secondary γ′ precipitates that are between 50 and 200 nm and tertiary γ′ precipitates that are less than 35 nm.

As well as optimising precipitation hardening, there is merit in improving the resistance of the γ phase to plastic and creep deformation. This can be achieved in the proposed alloys by maintaining Mo+0.38W levels, in atomic percent, of at least 2.44 but preferably higher (Table 3). Molybdenum preferentially partitions to the γ phase and acts as a relatively slow diffusing heavy element within the γ phase. This is advantageous for resistance to creep deformation and is due to the larger atomic size of Mo atoms compared to Ni or Co atoms. As they are large atoms, they increase the lattice parameter of the γ phase ($a_\gamma$). This is important as the lattice parameter of γ′ ($a_{\gamma'}$) also increases as a result of additions of W, Ta and Nb. It is advantageous that the misfit (δ) or difference in the lattice parameters, see equation 1, between the γ and γ′ phases is minimised and is preferably negative at temperatures above 800° C. as this minimises the rate of coarsening of γ′ particles, the presence and size of which strongly affect high temperature strength and resistance to creep deformation.

$$\delta = \frac{2(a_{\gamma'} - a_\gamma)}{a_\gamma + a_{\gamma'}} \quad \text{(Equation 1)}$$

The values of δ have been estimated for the proposed alloys using the respective lattice parameters for γ ($a_\gamma$) and γ′ ($a_{\gamma'}$), which were calculated from molar volume values of the phases from phase diagram modelling and Avogadro's constant. These were negative at 700° C., in the range of −0.2 to −0.45% for example alloys 1 to 12 (Table 2). A further consequence of adding higher amounts of Mo is the increased risk of forming Mo rich carbides and borides, which is mitigated by reducing the C and B content.

The aim in designing the proposed alloys is to minimise the occurrence and size of grain boundary carbides ($M_6C$, MC) and borides ($M_2B$) in alloys prepared by casting or ingot metallurgy, i.e. conventional vacuum induction melting (VIM) and subsequent remelting processes such as vacuum arc remelting (VAR) and electroslag remelting (ESR), which are processes that are used for producing nickel base superalloy ingots. It is proposed that a continuous or significant decoration of grain boundary carbides, in particular, is detrimental in nickel-cobalt based superalloys as they promote grain boundary cracking and reduce ductility. In the proposed compositions, the levels of C and B have been selected to minimise grain boundary decoration of carbides and borides but provide benefits in terms of (i) resistance to solidification cracking or hot tearing, and (ii) beneficial segregation of elemental B at grain boundaries for chemical bonding, for inhibiting the formation of grain boundary $M_{23}C_6$ carbides and for promoting the precipitation of intergranular secondary γ'. In experimental work that has been undertaken to establish the proposed compositions, intergranular $M_6C$ (where M=Cr, Mo, W) carbide has been found in alloys with more than 0.15 at. % (0.03 wt. %) C. The preference is to avoid $M_6C$ carbides. Boron reduces the incipient melting temperature of nickel alloys and is problematic for highly segregated areas in large castings, ingots or during welding. $M_2B$ has been detected in an alloy with 0.085 at. % (0.015 wt. %) B. It is understood, however, that the formation of $M_2B$ is reduced by additions of Ti and Zr, which has been confirmed by making up experimental alloys. The maximum B content in the proposed alloys is specified to be 0.02 wt. %. FIG. 1 shows the microstructure of an alloy, which is largely free of bright carbide and boride particles. This should be compared to FIG. 2(*b*) for an alloy, which contains 0.06 wt. % C and 0.02 wt. % B.

In the proposed alloys, an addition of at least 0.25 wt. % (about 0.3 at. %) Ti is made to form MC carbides in preference to Zr, W or Mo. Any remaining Ti that is added will partition to γ'. Primary MC carbides are formed first, during melting whereas $M_6C$ carbides form during subsequent thermo-mechanical processing and heat treatment. Excessive levels of W, Mo, Cr and Si can promote the formation $M_6C$ carbides and will be avoided in the proposed alloys.

Figure 2A:
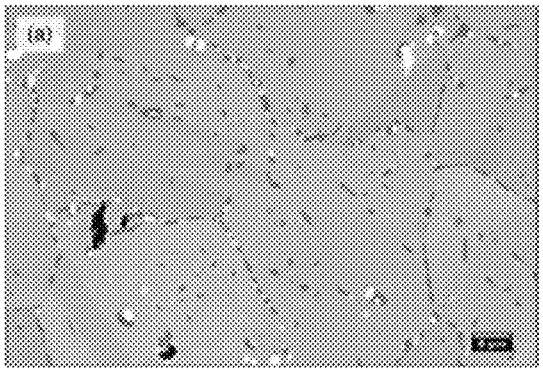
FIG. 2(*a*) and FIG. 2(*b*) illustrate backscatter electron images.
Figure 2B:
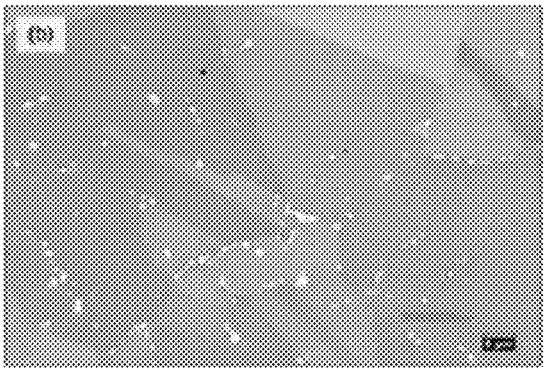

It has been discovered that the ordered intermetallic B2 type NiAl phase forms in alloys with 12 at. % Al, as shown in FIG. 2(*a*), in both inter- and intra-granular locations. When this phase is formed, $T_{solvus}$ of the γ' phase is reduced. The NiAl phase can be eliminated by reducing the Al content to below 11.5 at. %.

In the proposed alloys, the specified Al values (9-11.5 at. %) can produce a continuous alumina ($Al_2O_3$) layer below the chromia scale during long term exposure of the proposed alloys at temperatures above 800° C. This is a highly desirable condition as alumina provides a very effective barrier to penetration of oxygen from the surface into the alloy. There is a greater chance of forming a continuous alumina layer in the proposed alloys for those Al levels at the upper end of the specification and if the Al:Cr ratio in atomic percent is close to 1:1.

The phase stability of the proposed alloys has been assessed using phase diagram modelling and the approach reported by M. Morinaga et al. (Superalloys 1984, M. Gell, ed., TMS, Warrendale, Pa., USA, pp. 523-532), which uses theoretical calculations of electronic structure to determine an average energy level of d orbitals of transition metal additions to nickel. This is known as an average $Md_\gamma$ number for the γ phase. The approach has been reported to predict the occurrence of detrimental topologically close packed (TCP) phases such as sigma (σ) phase in a wide range of commercial alloys. However, the accuracy of the approach relies on defining a critical average $Md_\gamma$ value, below which a TCP free microstructure is assured. Using phase diagram modelling to predict the composition of the γ phase, it has been found that increasing Ni content reduces the average $Md_\gamma$ value, whereas increasing W and the addition of Fe, to replace Co or Ni, increases the average $Md_\gamma$ value. As such, the W and Fe contents in the proposed alloys have been limited to less than 9.5 and 5.5 weight percent respectively. Similarly, limits have also been imposed on small additions of Si and Mn as these elements also increase the average $Md_\gamma$ value.

It is desirable to add Zr in the proposed alloys but without introducing detrimental effects as the element can optimise grain boundary strength and ductility. For both cast and forged polycrystalline superalloys that are used in gas turbine applications, Zr provides improved high temperature tensile ductility and strength, creep life and rupture strength. Furthermore, Zr has an affinity for O and S and scavenges these elements, thereby limiting the potential of oxides and S or sulphides to reduce grain boundary cohesion. It also contributes to stable primary MC carbides and can be the sole MC carbide if Ti is not present in the alloy. It is proposed that alloys contain a small addition of Ti (at least 0.3 at. %) to enable TiC to form in preference to ZrC. Excessive quantities of Zr can detrimentally affect solidification behaviour (the thin film stage of solidification in which thin liquid films separate dendrites) and produce small oxide particles during melting, which can agglomerate and be sources of fatigue crack nucleation. Thus, in a specific embodiment, Zr is included in the alloy at a concentration of 0.005 to 0.06 weight percent, which achieves adequate S and O scavenging and grain boundary strengthening, without excessive formation of Zr oxides.

Up to 0.6 wt. % Mn is specified in the proposed alloys. Manganese is also a scavenger of S. There are additional benefits in adding Mn as it forms spinel oxide ($Cr_2MnO_4$) particles above or within chromia scale. It is proposed that such spinel particles can reduce the rate of oxidation.

Up to 0.3 wt. % Si is specified in the proposed alloys. An addition of Si can improve oxidation resistance as silica ($SiO_2$) particles that are present below the chromia scale are known to promote the formation of a continuous alumina layer beneath chromia. As discussed previously, however, excessive Si reduces phase stability and promotes the formation of $M_6C$ carbides.

Up to 0.1 wt. % Hf is specified in the proposed alloys. Hafnium produces similar effects and benefits to those from Zr.

In the absence of water vapour, chromia ($Cr_2O_3$) can provide a protective scale on the surface of Ni, Co based alloys at temperatures below 1000° C. However, the effectiveness of the scale depends on the Cr content, the environment and the presence of any corrosive species. Ideally a Cr content of above 20 wt. % would be added to produce a continuous protective chromia scale. However, in the proposed alloys, a maximum limit of 13.75 at. % Cr (about 12 wt. %) is specified as (i) higher Cr values produce excessive amounts of Cr rich $M_6C$ carbides at grain boundaries, which are detrimental as they promote grain boundary fracture and reduced ductility and (ii) higher Cr values produce higher average $Md_\gamma$ values, which indicate a greater susceptibility to formation of detrimental TCP phases such as σ A thin chromia scale is produced, with reduced rates of oxidation, if Ti content is minimised or eliminated as Ti tends to segregate at the grain boundaries of chromia scale. Titanium is therefore considered detrimental to oxidation resistance and is specified to levels below 2.5 at. % (or about 2.2 wt. %). In terms of oxidation damage, the proposed alloys showed the most effective resistance, i.e. the least depth of damage when a continuous alumina layer was formed. This is most likely in compositions that show high values of Cr and Al to maximise the Cr:Ti and Al:Cr ratios in atomic percent.

Ideally, a reduced Co content (20 at. %) is preferred to promote improved resistance to type II hot corrosion damage (from $Na_2SO_4$ based salts in the presence of $SO_2$) since the melting temperature of $Na_2SO_4$—$CoSO_4$ eutectic is 565° C. (K. L. Luthra, 1982, *Met. Trans. A,* 13, p. 1843), compared to $Na_2SO_4$—$NiSO_4$, which melts at 671° C. (K. P. Lillerud and P. Kofstad, 1984, *Oxid. Met.,* 21, p. 233).

The proposed alloys can be readily hot formed above $T_{solvus}$ despite having a large volume fraction (up to 65%) of γ' precipitates. The hot working range of the alloy is much larger than that for nickel-based alloys with similar fractions of γ' precipitates.

The good formability of these alloys is achieved as a result of the large temperature range between $T_{solvus}$ and the incipient melting temperature or solidus temperature. For the proposed alloys, $T_{solvus}$ is between 1020 and 1125° C. and the difference between $T_{solvus}$ and the solidus temperature is at least 100° C. but preferably 200° C. or higher. For the example alloys in Table 4, $T_{solvus}$ is between 1047 and 1110° C. Increasing additions of Ni, Al, Ta and Ti raise $T_{solvus}$ whereas increasing Co and Cr levels reduce $T_{solvus}$.

Figure 3:
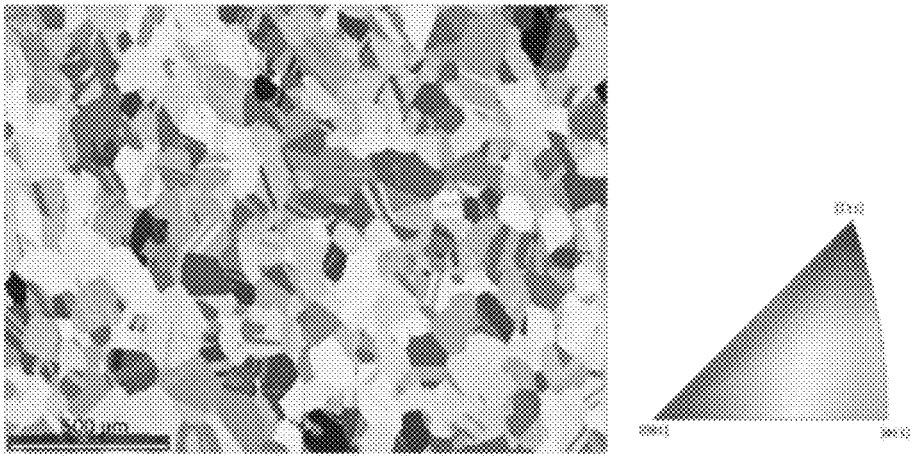
FIG. 3 illustrates the grain size of hot rolled and heat treated material that has been produced for the proposed alloys. The image is an orientation map (or an inverse pole figure) from electron backscattered diffraction (EBSD). As well as the orientations of grains, it clearly indicates grain size.

Given the high Ni content in the proposed alloys, the solidification or freezing range, i.e. the difference in temperature between the incipient melting temperature (solidus) and the liquidus temperature, is greater than 100° C., which may be sufficiently large to produce detrimental solidification anomalies (e.g. hot tearing) in large complex castings or remelt segregation anomalies (e.g. freckles) in large diameter ingots. The latter can be reduced by effective homogenisation heat treatments of small diameter ingots or eliminated using powder metallurgy. Similarly, it is possible that critical features of castings or wrought components that are made from the proposed alloys may be repaired using powder-based additive layer methods.

were homogenised in vacuum at 1200° C. for 48 hours, then hot rolled using cold rolls but with the alloy ingots initially at 1200° C., i.e. above $T_{solvus}$ from an initial thickness of 23 mm to 12 mm, using successive 12-15% reductions. Samples for testing were electrical discharge machined from the rolled bars, and encapsulated in back-filled argon quartz tubes for heat treatment. They were brought to the solution heat treatment temperature of 1100° C. at 4° C./min (above 500° C.), soaked for 1 hour; cooled at 20° C./min to 800° C., and aged for 4 h; cooled at 20° C./min to 500° C., and finally air cooled. This procedure enables small quantities of development alloys to be produced quickly, which is ideal for evaluating many compositions. It produces an average size (including twins) of 30-60 μm (FIG. 3), with isolated grains as large as 100-350 μm. Further grain refinement can be achieved through post dynamic recrystallization at a temperature about 25° C. below $T_{solvus}$ for 1-4 hours.

A NETZSCH Jupiter differential scanning calorimeter (DSC) was employed to determine $T_{solvus}$ at a 10° C./minute scan rate under argon atmosphere. Alloy compositions were measured using Inductively Coupled Plasma-Optical Emission Spectroscopy (ICP-OES) and density measurements were performed according to ASTM B311-08 at room temperature.

The compositional ranges disclosed herein are inclusive and combinable, are inclusive of the endpoints and all intermediate values of the ranges). The modifier "about" used in connection with a quantity is inclusive of the stated value, and has the meaning dictated by context, (e.g., includes the degree of error associated with measurement of the particular quantity).

TABLE 1

Ranges of chemical elements in alloys (in weight percent)

| wt. % | Ni | Co | Cr | Fe | W | Mo | Al | Ta | Nb | Ti | Mn | Si | Hf | C | B | Zr |
|---|---|---|---|---|---|---|---|---|---|---|---|---|---|---|---|---|
| min | 33.5 | 19.5 | 9 | 0 | 4.5 | 2 | 3.9 | 0.6 | 0 | 0.2 | 0.0 | 0.0 | 0 | 0.005 | 0.001 | 0.005 |
| max | 54 | 36 | 12 | 5.5 | 9.5 | 3.5 | 5.5 | 5 | 1.75 | 2.2 | 0.6 | 0.3 | 0.1 | 0.03 | 0.02 | 0.06 |

Example alloys were initially produced from high-purity elemental pellets as 450 g ingots by vacuum arc melting under a back-filled argon atmosphere. The as-cast ingots Table 1 illustrates the ranges of weight percentages for chemical elements in a nickel-cobalt alloy according to the invention.

Tables 2A and 2B - Example alloys

Table 2A - Atomic %

| Alloy | Ni | Co | Cr | Fe | W | Mo | Al | Ta | Nb | Ti | Mn | Si | C | B | Zr |
|---|---|---|---|---|---|---|---|---|---|---|---|---|---|---|---|
| 1 | 35.7 | 35.7 | 12.0 | 0.0 | 1.75 | 1.80 | 9.10 | 1.00 | 1.00 | 1.85 | 0.00 | 0.0 | 0.075 | 0.050 | 0.025 |
| 2 | 40.4 | 31.0 | 12.0 | 0.0 | 1.75 | 1.80 | 9.10 | 1.00 | 1.00 | 1.85 | 0.00 | 0.0 | 0.075 | 0.050 | 0.025 |
| 3 | 38.4 | 28.0 | 12.0 | 5.0 | 1.75 | 1.80 | 9.10 | 1.00 | 1.00 | 1.85 | 0.00 | 0.0 | 0.075 | 0.050 | 0.025 |
| 4 | 37.6 | 28.0 | 12.0 | 5.0 | 1.75 | 1.80 | 9.10 | 1.00 | 1.00 | 1.85 | 0.55 | 0.2 | 0.075 | 0.050 | 0.025 |
| 5 | 51.6 | 20.0 | 12.0 | 0.0 | 2.00 | 1.75 | 9.75 | 1.00 | 0.50 | 1.25 | 0.00 | 0.0 | 0.075 | 0.050 | 0.020 |
| 6 | 40.9 | 31.0 | 12.0 | 0.0 | 1.75 | 1.80 | 9.10 | 1.00 | 0.00 | 2.30 | 0.00 | 0.0 | 0.075 | 0.050 | 0.025 |
| 7 | 35.2 | 35.2 | 12.0 | 0.0 | 2.75 | 2.00 | 10.00 | 1.25 | 0.00 | 1.20 | 0.00 | 0.0 | 0.100 | 0.012 | 0.020 |
| 8 | 34.8 | 34.8 | 12.0 | 0.0 | 2.75 | 2.00 | 10.00 | 1.25 | 0.00 | 2.30 | 0.00 | 0.0 | 0.100 | 0.042 | 0.020 |
| 9 | 35.5 | 35.5 | 12.0 | 0.0 | 2.75 | 2.00 | 10.00 | 1.25 | 0.50 | 0.30 | 0.00 | 0.0 | 0.100 | 0.042 | 0.020 |
| 10 | 35.3 | 35.3 | 12.0 | 0.0 | 2.75 | 2.00 | 10.00 | 1.25 | 1.00 | 0.30 | 0.00 | 0.0 | 0.100 | 0.042 | 0.020 |
| 11 | 52.3 | 20.0 | 12.0 | 0.0 | 2.00 | 1.75 | 9.75 | 0.25 | 0.25 | 1.00 | 0.00 | 0.52 | 0.075 | 0.050 | 0.020 |
| 12 | 34.7 | 34.7 | 13.0 | 0.0 | 2.75 | 2.00 | 11.5 | 1.25 | 0.00 | 0.00 | 0.00 | 0.0 | 0.075 | 0.085 | 0.040 |

Table 2B - Weight %

| Alloy | N | Co | Cr | Fe | W | Mo | Al | Ta | Nb | Ti | Mn | Si | C | B | Zr |
|---|---|---|---|---|---|---|---|---|---|---|---|---|---|---|---|

-continued

| Tables 2A and 2B - Example alloys | | | | | | | | | | | | | | | |
|---|---|---|---|---|---|---|---|---|---|---|---|---|---|---|---|
| 1 | 35.5 | 35.5 | 10.5 | 0.0 | 5.39 | 2.90 | 4.15 | 3.00 | 1.50 | 1.50 | 0.0 | 0.0 | 0.015 | 0.009 | 0.039 |
| 2 | 40.0 | 31.1 | 10.5 | 0.0 | 5.39 | 2.90 | 4.15 | 3.00 | 1.50 | 1.50 | 0.0 | 0.0 | 0.015 | 0.009 | 0.039 |
| 3 | 37.9 | 28.1 | 10.5 | 5.0 | 5.39 | 2.92 | 4.15 | 2.99 | 1.50 | 1.50 | 0.0 | 0.0 | 0.015 | 0.009 | 0.038 |
| 4 | 37.5 | 28.0 | 10.5 | 5.0 | 5.39 | 2.90 | 4.15 | 3.00 | 1.50 | 1.50 | 0.5 | 0.1 | 0.015 | 0.009 | 0.038 |
| 5 | 50.8 | 19.8 | 10.5 | 0.0 | 6.20 | 2.80 | 4.40 | 3.80 | 0.80 | 0.80 | 0.0 | 0.0 | 0.015 | 0.009 | 0.030 |
| 6 | 40.8 | 31.0 | 10.6 | 0.0 | 5.47 | 2.93 | 4.17 | 3.07 | 0.00 | 1.87 | 0.0 | 0.0 | 0.015 | 0.009 | 0.039 |
| 7 | 34.3 | 34.5 | 10.3 | 0.0 | 8.38 | 3.18 | 4.47 | 3.75 | 0.00 | 1.03 | 0.0 | 0.0 | 0.020 | 0.008 | 0.030 |
| 8 | 33.9 | 34.0 | 10.4 | 0.0 | 8.40 | 3.19 | 4.48 | 3.76 | 0.00 | 1.83 | 0.0 | 0.0 | 0.020 | 0.008 | 0.030 |
| 9 | 34.4 | 34.5 | 10.3 | 0.0 | 8.34 | 3.17 | 4.45 | 3.73 | 0.77 | 0.24 | 0.0 | 0.0 | 0.020 | 0.007 | 0.030 |
| 10 | 34.1 | 34.2 | 10.3 | 0.0 | 8.32 | 3.16 | 4.44 | 3.72 | 1.53 | 0.24 | 0.0 | 0.0 | 0.020 | 0.007 | 0.030 |
| 11 | 52.9 | 20.3 | 10.7 | 0.0 | 6.33 | 2.89 | 4.53 | 0.78 | 0.40 | 0.82 | 0.0 | 0.25 | 0.016 | 0.009 | 0.031 |
| 12 | 33.9 | 34.1 | 11.3 | 0.0 | 8.44 | 3.20 | 5.18 | 3.78 | 0.00 | 0.00 | 0.0 | 0.0 | 0.015 | 0.015 | 0.061 |

Table 2A illustrates the atomic percentages for chemical elements in twelve example nickel-cobalt alloys, 1 to 12, according to the invention; and Table 2B illustrates the weight percentages for chemical elements in the twelve example nickel-cobalt alloys 1 to 12.

TABLE 3

Attributes of example alloys in atomic %

| Alloy | (i) Ni:Co | (ii) Mo + 0.38 W | (iii) Al + Ta + Nb + Ti + 0.62 W | (iv) W + Ta + Nb |
|---|---|---|---|---|
| 1 | 1:1 | 2.47 | 14.04 | 3.75 |
| 2 | 1.3:1 | 2.47 | 14.04 | 3.75 |
| 3 | 1.4:1 | 2.47 | 14.04 | 3.75 |
| 4 | 1.3:1 | 2.47 | 14.04 | 3.75 |
| 5 | 2.6:1 | 2.51 | 13.74 | 3.50 |
| 6 | 1.3:1 | 2.47 | 13.49 | 2.75 |
| 7 | 1:1 | 3.05 | 14.26 | 4.00 |
| 8 | 1:1 | 3.05 | 15.26 | 4.00 |
| 9 | 1:1 | 3.05 | 13.76 | 4.50 |
| 10 | 1:1 | 3.05 | 14.26 | 5.00 |
| 11 | 2:6 | 2.51 | 12.5 | 2.50 |
| 12 | 1 | 3.05 | 14.5 | 4.00 |

Table 3 illustrates attributes of the twelve example nickel-cobalt alloys 1 to 12 in atomic percent in terms of: (i) nickel:cobalt ratio; (ii) combined molybdenum and 0.38 of tungsten content, which is used to optimise the properties of the γ phase and contributes to alloy density; (iii) combined aluminium, tantalum, niobium, titanium and 0.62 of tungsten content, which indicates the volume fraction of the γ' phase; (iv) combined tungsten, tantalum and niobium content, which contributes to alloy density.

TABLE 4

Measured values for ambient temperature density (ρ) and gamma prime solvus ($T_{solvus}$).

| Alloy | ρ (g · cm$^{-3}$) | $T_{solvus}$ (° C.) |
|---|---|---|
| 1 | 8.4 | 1073 |
| 2 | 8.22 | 1086 |
| 4 | 8.28 | 1047 |
| 5 | 8.39 | 1110 |
| 7 | 8.61 | 1067 |
| 8 | 8.53 | 1090 |
| 9 | 8.69 | 1049 |
| 10 | 8.74 | 1062 |

Table 4 illustrates the density and gamma prime solvus temperature of eight of the twelve example nickel-cobalt alloys: 1, 2, 4, 5, 7, 8, 9, and 10.

TABLE 5

Data from tensile tests at 20° C. where YS is yield stress and TS is tensile strength

| Alloy | 20° C. YS (MPa) | 20° C. TS (MPa) |
|---|---|---|
| 1 | 915 | 1336 |
| 2 | 902 | 1325 |
| 7 | 937 | 1329 |
| 8 | 1000 | 1336 |
| 9 | 953 | 1363 |
| 10 | 940 | 1336 |

Table 5 illustrates ambient temperature yield stress and tensile strength of six of the twelve example nickel-cobalt alloys: 1, 2, 7, 8, 9, and 10.

The invention claimed is:

1. A nickel-cobalt based superalloy composition consisting of, by weight:

33.5 to 54 percent nickel;
19.5 to 36 percent cobalt;
9.0 to 12.0 percent chromium;
3.9 to 5.5 percent aluminium;
5.39 to 9.5 percent tungsten;
up to 5.5 percent iron;
2 to 3.5 percent molybdenum;
0.6 to 5 percent tantalum;
0.15 to 2.2 percent titanium;
up to 1.75 percent niobium;
up to 0.1 percent hafnium;
0.005 to 0.03 percent carbon;
0.001 to 0.02 percent boron;
0.005 to 0.06 percent zirconium;
up to 0.3 percent silicon;
up to 0.6 percent manganese; and
the balance being impurities.

2. A nickel-cobalt based superalloy according to claim 1, wherein the nickel and cobalt (Ni:Co) are present in the ratio between 1:1 and about 2.6:1 in atomic percent.

3. A nickel-cobalt based superalloy as claimed in claim 1 comprising by atomic percentage:

9-11.5 percent aluminium;
1.5 to 3 percent tungsten;
0.25-1.6 percent tantalum;
0.3-2.5 percent titanium; and
up to 1 percent niobium;
wherein a combined atomic percentage of aluminium, tantalum, titanium, niobium and 0.62 of tungsten in the nickel-cobalt based superalloy is between 12.5 and 16.25 percent to provide substantially 50 to 65 percent by volume gamma prime precipitates.

4. A nickel-cobalt based superalloy according to claim 1 comprising by atomic percentage:
1.5-3 percent tungsten;
1.3-2 percent molybdenum;
wherein a combined atomic percentage of Mo+0.38 of W in the nickel-cobalt based superalloy is at least 2.44 percent.

5. A nickel-cobalt based superalloy as claimed in claim 1, wherein:
the density at ambient temperature is less than 8.5 grams per cubic centimetre; and
a combined atomic percentage of Mo+0.38 is no greater than 2.5 percent and a combined atomic percentage of W+Ta+Nb is no greater than 3.8 percent.

6. A nickel-cobalt based superalloy according to claim 1, wherein the nickel-cobalt based superalloy has a gamma prime solvus temperature of 1020 to 1125° C.

7. A nickel-cobalt based superalloy as claimed in claim 1, and comprising by weight:
47 to 54 percent nickel; and
19.5 to 25 percent cobalt.

8. A nickel-cobalt based superalloy as claimed in claim 1, wherein the nickel-cobalt based superalloy consists of, by weight:
35.5% cobalt;
10.5% chromium;
5.4% tungsten;
2.9% molybdenum;
4.15% aluminium;
3% tantalum;
1.5% niobium;
1.5% titanium;
0.015% carbon;
0.009% boron;
0.039% zirconium; and
the balance being nickel and impurities.

9. A nickel-cobalt based superalloy as claimed in claim 1, wherein the nickel-cobalt based superalloy consists of, by weight:
31.1% cobalt;
10.5% chromium;
5.4% tungsten;
2.9% molybdenum;
4.15% aluminium;
3% tantalum;
1.5% niobium;
1.5% titanium;
0.015% carbon;
0.009% boron;
0.039% zirconium; and
the balance being nickel and impurities.

10. A nickel-cobalt based superalloy as claimed in claim 1, wherein the nickel-cobalt based superalloy consists of, by weight:
28.1% cobalt;
10.5% chromium;
5% iron;
5.4% tungsten;
2.9% molybdenum;
4.15% aluminium;
3% tantalum;
1.5% niobium;
1.5% titanium;
0.015% carbon;
0.009% boron;
0.039% zirconium; and
the balance being nickel and impurities.

11. A nickel-cobalt based superalloy as claimed in claim 1, wherein the nickel-cobalt based superalloy consists of, by weight:
28.0% cobalt;
10.5% chromium;
5% iron;
5.4% tungsten;
2.9% molybdenum;
4.15% aluminium;
3% tantalum;
1.5% niobium;
1.5% titanium;
0.5% manganese;
0.1% silicon;
0.015% carbon;
0.009% boron;
0.039% zirconium; and
the balance being nickel and impurities.

12. A nickel-cobalt based superalloy as claimed in claim 1, wherein the nickel-cobalt based superalloy consists of, by weight:
19.8% cobalt;
10.5% chromium;
6.2% tungsten;
2.8% molybdenum;
4.4% aluminium;
3.8% tantalum;
0.8% niobium;
0.8% titanium;
0.015% carbon;
0.009% boron;
0.030% zirconium; and
the balance being nickel and impurities.

13. A nickel-cobalt based superalloy as claimed in claim 1, wherein the nickel-cobalt based superalloy consists of, by weight:
31.0% cobalt;
10.6% chromium;
5.5% tungsten;
2.9% molybdenum;
4.2% aluminium;
3.1% tantalum;
1.9% titanium;
0.015% carbon;
0.009% boron;
0.039% zirconium; and
the balance being nickel and impurities.

14. A nickel-cobalt based superalloy as claimed in claim 1, wherein the nickel-cobalt based superalloy consists of, by weight:
34.5% cobalt;
10.3% chromium;
8.4% tungsten;
3.2% molybdenum;
4.5% aluminium;
3.75% tantalum;
1.0% titanium;
0.020% carbon;
0.008% boron;
0.030% zirconium; and
the balance being nickel and impurities.

15. A nickel-cobalt based superalloy as claimed in claim 1, wherein the nickel-cobalt based superalloy consists of, by weight:
34.0% cobalt;
10.4% chromium;
8.4% tungsten;

3.2% molybdenum;
4.5% aluminium;
3.75% tantalum;
1.8% titanium;
0.020% carbon;
0.008% boron;
0.030% zirconium; and
the balance being nickel and impurities.

16. A nickel-cobalt based superalloy as claimed in claim 1, wherein the nickel-cobalt based superalloy consists of, by weight:
34.5% cobalt;
10.3% chromium;
8.3% tungsten;
3.2% molybdenum;
4.45% aluminium;
3.7% tantalum;
0.8% niobium;
0.25% titanium;
0.020% carbon;
0.007% boron;
0.030% zirconium; and
the balance being nickel and impurities.

17. A nickel-cobalt based superalloy as claimed in claim 1, wherein the nickel-cobalt based superalloy consists of, by weight:
34.2% cobalt;
10.3% chromium;
8.3% tungsten;
3.2% molybdenum;
4.4% aluminium;
3.7% tantalum;
1.5% niobium;
0.25% titanium;
0.020% carbon;
0.007% boron;
0.030% zirconium; and
the balance being nickel and impurities.

18. A nickel-cobalt based superalloy as claimed in claim 1, wherein the nickel-cobalt based superalloy consists of, by weight:
20.3% cobalt;
10.7% chromium;
6.3% tungsten;
2.9% molybdenum;
4.5% aluminium;
0.8% tantalum;
0.4% niobium;
0.8% titanium;
0.25% silicon;
0.015% carbon;
0.009% boron;
0.030% zirconium; and
the balance being nickel and impurities.

19. A nickel-cobalt based superalloy as claimed in claim 1, wherein the nickel-cobalt based superalloy consists of, by weight:
34.1% cobalt;
11.3% chromium;
8.4% tungsten;
3.2% molybdenum;
5.2% aluminium;
3.8% tantalum;
0.015% carbon;
0.015% boron;
0.060% zirconium; and
the balance being nickel and impurities.

20. A nickel-cobalt based superalloy composition consisting of, by weight:
33.5 to 54 percent nickel;
19.5 to 36 percent cobalt;
9.0 to 12.0 percent chromium;
3.9 to 5.5 percent aluminium;
4.5 to 9.5 percent tungsten;
up to 5.5 percent iron;
2 to 3.5 percent molybdenum;
0.6 to 3.4 percent tantalum;
0.15 to 2.2 percent titanium;
up to 1.75 percent niobium;
up to 0.1 percent hafnium;
0.005 to 0.03 percent carbon;
0.001 to 0.02 percent boron;
0.005 to 0.06 percent zirconium;
up to 0.3 percent silicon;
up to 0.6 percent manganese; and
the balance being impurities.

21. A nickel-cobalt based superalloy composition consisting of, by weight:
33.5 to 54 percent nickel;
19.5 to 36 percent cobalt;
9.0 to 12.0 percent chromium;
3.9 to 5.5 percent aluminium;
4.5 to 9.5 percent tungsten;
up to 5.5 percent iron;
2 to 3.5 percent molybdenum;
0.6 to 3.80 percent tantalum;
0.15 to 2.2 percent titanium;
up to 1.75 percent niobium;
up to 0.1 percent hafnium;
0.005 to 0.03 percent carbon;
0.001 to 0.02 percent boron;
0.005 to 0.06 percent zirconium;
up to 0.3 percent silicon;
up to 0.6 percent manganese; and
the balance being impurities,
wherein the nickel-cobalt based superalloy has a bimodal size distribution of γ' precipitates that includes:
secondary γ' precipitates that are between 50 and 200 nm in size, and
tertiary γ' precipitates that are less than 35 nm in size.

* * * * *